US009834986B2

(12) United States Patent
Bohlen et al.

(10) Patent No.: US 9,834,986 B2
(45) Date of Patent: Dec. 5, 2017

(54) ARCHITECTURAL COVERING HAVING A DRIVE MECHANISM

(71) Applicant: Hunter Douglas Industries B.V., Rotterdam (NL)

(72) Inventors: Jorg Bohlen, Langen (DE); Lars Koop, Bremerhaven (DE)

(73) Assignee: Hunter Douglas Industries B.V., Rotterdam (NL)

( * ) Notice: Subject to any disclaimer, the term of this patent is extended or adjusted under 35 U.S.C. 154(b) by 0 days.

(21) Appl. No.: 14/380,925

(22) PCT Filed: Feb. 27, 2013

(86) PCT No.: PCT/NL2013/000009
§ 371 (c)(1),
(2) Date: Aug. 25, 2014

(87) PCT Pub. No.: WO2013/129916
PCT Pub. Date: Sep. 6, 2013

(65) Prior Publication Data

US 2015/0034259 A1 Feb. 5, 2015

(30) Foreign Application Priority Data

Feb. 27, 2012 (NL) ..... 1039407

(51) Int. Cl.
*E06B 9/72* (2006.01)
*E06B 9/62* (2006.01)
(Continued)

(52) U.S. Cl.
CPC ..... *E06B 9/72* (2013.01); *E06B 9/42* (2013.01); *E06B 9/62* (2013.01); *E06B 9/50* (2013.01)

(58) Field of Classification Search
CPC ..... E06B 9/72
(Continued)

(56) References Cited

U.S. PATENT DOCUMENTS 1,678,590 A 7/1928 Dixson
1,733,176 A 10/1929 Winter
(Continued)

FOREIGN PATENT DOCUMENTS

AU 622268 B2 9/1991
CA 1301052 C 5/1992
(Continued)

OTHER PUBLICATIONS

PCT International Search Report dated Sep. 15, 2009, PCT Application No. PCT/US2009/051405, 3 pages.
(Continued)

*Primary Examiner* — Blair M Johnson
(74) *Attorney, Agent, or Firm* — Hanley, Flight and Zimmerman, LLC

(57) ABSTRACT

An architectural covering having a drive mechanism for extending and retracting a covering member between opposite first and second end positions. The drive mechanism includes an electric motor unit having a stationary end and a rotating end for rotating a winding core, such as a roller blind shaft, for receiving wound layers of a flexible element, such as a sheet of flexible material thereon. The drive mechanism further includes a motor head, separate from the electric motor unit, providing external electrical control for the motor unit via an electrical interface. A printed circuit board accommodated in the motor head may include at least one of end position limit switches, a switch for setting the first and second end positions, electronic communication means, or a remote control receiver. The electrical interface
(Continued)

may include an electrical connector plug, an electrical socket, and/or an electrical cable.

27 Claims, 8 Drawing Sheets

(51) Int. Cl.
*E06B 9/42* (2006.01)
*E06B 9/50* (2006.01)

(58) Field of Classification Search
USPC ..... 160/310
See application file for complete search history.

(56) References Cited

U.S. PATENT DOCUMENTS 1,938,729 A 12/1933 Traut
2,124,037 A 7/1938 Lavigne
2,540,742 A 2/1951 Langer
2,674,306 A 4/1954 Prieto
2,722,273 A 11/1955 Taylor
2,842,198 A 7/1958 Prieto
3,030,535 A 4/1962 Wiesner
3,308,873 A 3/1967 Dotto
3,310,099 A 3/1967 Hunter et al.
3,340,835 A 9/1967 Cook et al.
3,451,639 A 6/1969 Atwood et al.
3,459,978 A 8/1969 Trucks et al.
3,809,143 A 5/1974 Ipekgil
4,030,567 A 6/1977 Kondo
4,159,162 A 6/1979 Christoffel
4,171,845 A 10/1979 Hirsch
4,178,955 A 12/1979 Dau
4,417,185 A * 11/1983 Bullat ..... E06B 9/74 160/1
4,471,248 A 9/1984 Smetana
4,535,830 A 8/1985 Appel et al.
4,623,812 A 11/1986 van de Griend
4,663,575 A 5/1987 Juzswik et al.
4,766,941 A 8/1988 Sloop et al.
4,768,925 A 9/1988 Geupel
4,827,199 A 5/1989 Kaucic et al.
4,843,297 A 6/1989 Landino et al.
4,878,528 A 11/1989 Kobayashi
4,884,618 A 12/1989 Steeves
4,885,948 A 12/1989 Thrasher, Jr. et al.
5,010,940 A 4/1991 Marocco
5,044,417 A 9/1991 Bresson
5,105,871 A 4/1992 Baud et al.
5,167,269 A 12/1992 Abo
5,274,499 A 12/1993 Shopp
5,437,324 A 8/1995 Sternquist
5,460,216 A 10/1995 Hirao et al.
5,467,266 A 11/1995 Jacobs et al.
5,495,153 A 2/1996 Domel et al.
5,515,898 A 5/1996 Alcocer
5,517,094 A 5/1996 Domel et al.
5,671,387 A 9/1997 Jacobs et al.
5,760,558 A 6/1998 Popat
5,772,274 A 6/1998 Tokarz
5,786,647 A 7/1998 Vollmer
5,793,174 A 8/1998 Kovach et al.
5,799,716 A 9/1998 Yamaguchi et al.
5,803,150 A 9/1998 Boiteau
5,975,185 A 11/1999 Miller et al.
6,064,165 A 5/2000 Boisvert et al.
6,111,694 A 8/2000 Shopp
6,230,785 B1 5/2001 Tokuyama et al.
6,328,274 B1 12/2001 Hayashi
6,378,594 B1 4/2002 Yamanaka et al.
6,487,267 B1 11/2002 Wolter
6,536,503 B1 3/2003 Anderson et al.
6,630,758 B2 10/2003 Aoki et al.
6,685,592 B2 2/2004 Fraczek et al.
6,759,817 B2 7/2004 Mersch
6,979,962 B2 12/2005 Cavarec et al.
7,195,052 B2 3/2007 Nien et al.
7,237,592 B2 7/2007 Arnoux et al.
7,389,806 B2 6/2008 Kates
7,407,040 B2 8/2008 Doran
7,723,939 B2 5/2010 Carmen, Jr.
7,726,379 B2 * 6/2010 Beau ..... E06B 9/72 160/310
7,967,051 B2 6/2011 Diaz et al.
8,193,742 B2 6/2012 Skinner et al.
8,205,657 B2 6/2012 Bohlen
8,258,993 B2 9/2012 Inoue et al.
8,299,734 B2 10/2012 Mullet et al.
8,307,878 B2 11/2012 Faller et al.
8,368,328 B2 * 2/2013 Mullet ..... E06B 9/42 160/133
8,461,784 B2 6/2013 Skinner et al.
8,723,454 B2 5/2014 Skinner et al.
8,776,861 B2 7/2014 Bohlen
9,410,371 B2 8/2016 Faller et al.
2001/0050538 A1 12/2001 Kovach et al.
2002/0190678 A1 12/2002 Huber et al.
2003/0000657 A1 1/2003 Dupielet et al.
2004/0226669 A1 11/2004 Webb
2005/0126723 A1 6/2005 Arnoux et al.
2007/0191126 A1 8/2007 Mandracken
2008/0044790 A1 2/2008 Fani et al.
2008/0060771 A1 3/2008 Sugiyama et al.
2008/0126723 A1 5/2008 Ashton et al.
2009/0059574 A1 3/2009 Lewis et al.
2010/0018654 A1 1/2010 Skinner et al.
2010/0175838 A1 * 7/2010 Faller ..... E06B 9/322 160/310
2010/0269988 A1 10/2010 Mullet
2011/0024064 A1 2/2011 Ng
2011/0048655 A1 * 3/2011 Andreasen ..... E06B 9/72 160/310
2011/0265958 A1 11/2011 Skinner et al.
2011/0297334 A1 * 12/2011 Bohlen ..... E06B 9/62 160/310
2012/0234504 A1 9/2012 Skinner et al.
2013/0068404 A1 3/2013 Faller et al.
2013/0269887 A1 10/2013 Skinner et al.
2015/0034259 A1 * 2/2015 Bohlen ..... E06B 9/42 160/310
2016/0138333 A2 5/2016 Bohlen et al.
2016/0340977 A1 11/2016 Faller et al.

FOREIGN PATENT DOCUMENTS

CN 2203571 Y 7/1995
CN 2490940 Y 5/2002
CN 2639497 Y 9/2004
CN 1643231 A 7/2005
CN 2793285 Y 7/2006
CN 200993888 Y 12/2007
CN 101285370 A 10/2008
DE 4211940 A1 10/1993
DE 19935729 A1 2/2001
EP 0651127 A1 5/1995
EP 1947288 A2 7/2008
EP 2256284 A2 12/2010
FR 403577 U1 11/1909
GB 1409891 A 10/1975
GB 2166480 A 5/1986
JP 5785482 A 5/1982
JP 2001040966 A 2/2001
JP 2002235488 A 8/2002
TW 514152 B 12/2002
WO 01/77479 A2 10/2001
WO 2005/085578 A2 9/2005
WO 2005/090736 A1 9/2005
WO 2005/121487 A1 12/2005
WO 2006/046103 A1 5/2006
WO 2008075494 A1 6/2008
WO 2008/141389 A1 11/2008

(56) References Cited

FOREIGN PATENT DOCUMENTS

| | | | |
|---|---|---|---|
| WO | 2008131761 | A1 | 11/2008 |
| WO | 2010/089118 | A1 | 8/2010 |
| WO | 2011/008267 | A2 | 1/2011 |

OTHER PUBLICATIONS

PCT International Search Report dated Jun. 21, 2013 for International Application No. PCT/NL2013/000009, 3 pages.
U.S. Appl. No. 14/309,571, filed Jun. 19, 2014.
U.S. Appl. No. 14/309,499, filed Jun. 19, 2014.

* cited by examiner

ARCHITECTURAL COVERING HAVING A DRIVE MECHANISM

CROSS-REFERENCE TO RELATED APPLICATIONS

This application is the national stage application of International Patent Application No. PCT/NL2013/000009, filed Feb. 27, 2013, entitled "Architectural Covering Having a Drive Mechanism", which claims priority to Netherlands Patent Application No. 1039407, filed Feb. 27, 2012, entitled "Architectural Covering Having a Drive Mechanism For Extending and Retracting a Covering Member Between Opposite First and Second End Positions," which are hereby incorporated by reference herein in their entireties.

FIELD

The invention relates to an architectural covering having a drive mechanism for extending and retracting a covering member between opposite first and second end positions.

BACKGROUND

It is known for such a drive mechanism to include an electric motor unit that has a stationary end and a rotating end. The rotating end being arranged for rotating a winding core for receiving wound layers of a flexible element. It has further been proposed for such a drive mechanism to also include a spring assist module for compensating the masses of the architectural covering between its opposite first and second end positions.

In a known architectural covering, as disclosed in applicant's international patent application published as WO 2010/089118, the spring assist module is required to be positioned at an outer end of the roller tube because its stationary central shaft requires a fixed connection to one of the mounting brackets. As a consequence the motor unit is arranged at an inward end of the spring assist module and is difficult to reach for adjustment or control. It would for instance be desirable when adjusting the end position limits, that it would not be necessary to disassemble the spring assist and motor units from the roller blind to enable such adjustments.

SUMMARY

Accordingly it is an object of the present invention to propose an improved drive mechanism for an extendable and retractable covering member of an architectural covering. In a more general sense it is thus an object of the invention to overcome or ameliorate at least one of the disadvantages of the prior art. It is also an object of the present invention to provide alternative structures which are less cumbersome in assembly and operation and which moreover can be made relatively inexpensively. Alternatively it is an object of the invention to at least provide the public with a useful choice.

To this end the invention provides an architectural covering having a drive mechanism for extending and retracting a covering member between opposite first and second end positions as defined in one or more of the appended claims. By housing the communication electronics, such as setting of first and second end positions and/or a remote control receiver, in a separate motor head it has become possible to access the appropriate controls without any disassembling. This has been enabled while retaining a fixed attachment for the spring assist module in the proximity of an outside end of a winding core, such as a blind roller. Mechanical changes to an electric motor unit that typically has a driving end and a stationary end are thereby also avoided. This keeps manufacturing costs low as standardized mass produced motor units can be employed as before.

BRIEF DESCRIPTION OF THE DRAWINGS

Further advantageous aspects of the invention will become clear from the appended description and in reference to the accompanying drawings, in which.

DETAILED DESCRIPTION

Figures 1, 2:
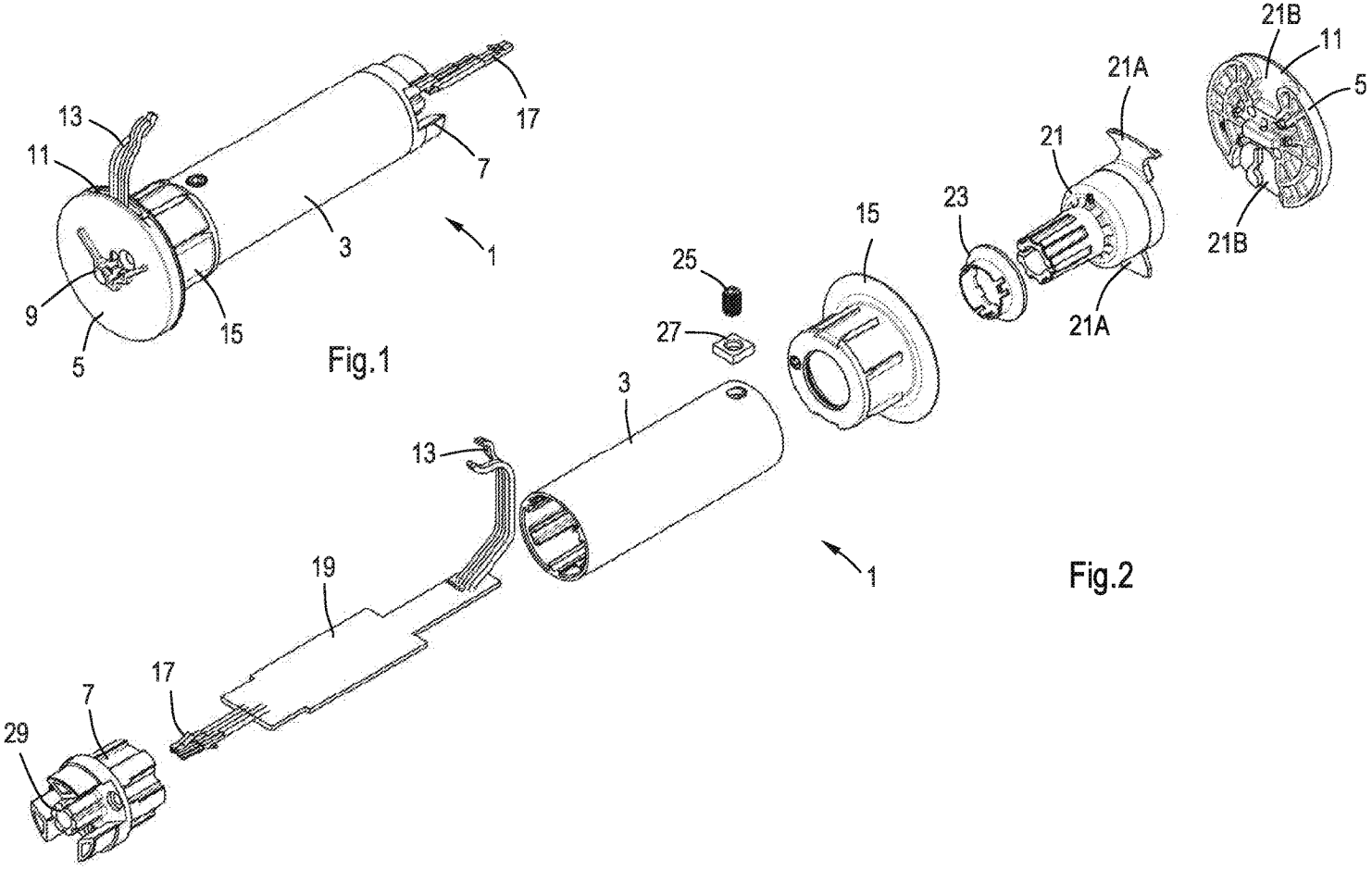
FIG. 1 is an isometric view of a motor head for use in a mechanism for extending and retracting an architectural covering.
FIG. 2 is an exploded isometric view of the motor head of FIG. 1.
Figure 11:
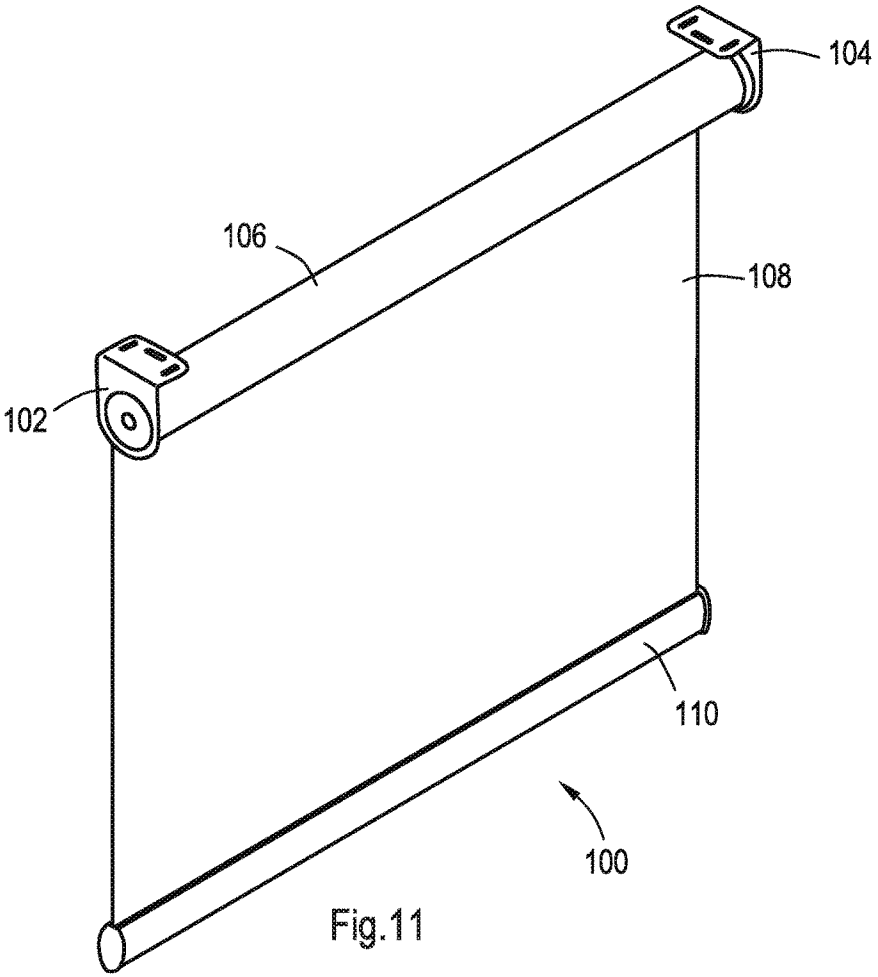
FIG. 11 shows a roller shade including the mechanism for extending and retracting in accordance with the present invention.

A motor head 1 for a drive mechanism of an architectural covering, such as roller shade 100 in FIG. 11, is shown in FIG. 1. The motor head 1 has a housing 3, an outer end member 5, and an inner end member 7. The outer end member 5 has coupling features 9 for engaging a mounting bracket, such as mounting brackets 102, 104 of FIG. 11. Further the outer end member 5 is provided with an entrance opening 11 for electrical wires 13. Journalled for rotation between the outer end member 5 and the housing 3 is a rotatable collar 15. Protruding from the inner end member 7 is an electrical connector plug 17. As illustrated in the exploded view of FIG. 2 the electrical wires 13 connect to a printed circuit board (PCB) 19, which in turn connects to the connector plug 17. The printed circuit board (19) is accommodated in the housing 3 of the motor head 1, and may include at least a selection of end position limit switches, a switch for setting the first and second end positions, electronic communication means, and/or a remote control receiver. Such devices are conventionally accommodated in the same unit that also houses an electric motor unit. According to the invention the motor head 1 does not include an electric motor unit, but merely provides external electrical control for such an electric motor unit. Hence the motor head 1 provides for an electrical interface with an electric motor unit that enables control of motor end positions and/or remote communication.

The rotatable collar 15 is journalled for rotation about stationary stub axle 21, via bearing ring 23. The stationary stub axle 21 is stationary held to the outer end member 5 by appropriate complementary mating formations 21A, 21B. The housing 3 accommodates the printed circuit board 19 and is stationery affixed to the stub axle 21 by means of a screw 25 and a nut 27. Upon assembly of the motor head 1, the inner end plug 7 also connects to the stationary housing 3 through mating ribs and serrations. Further the inner end plug 7 is provided with a coupling protrusion 29 for a stationary central shaft, as will be explained herein below.

Figure 3:
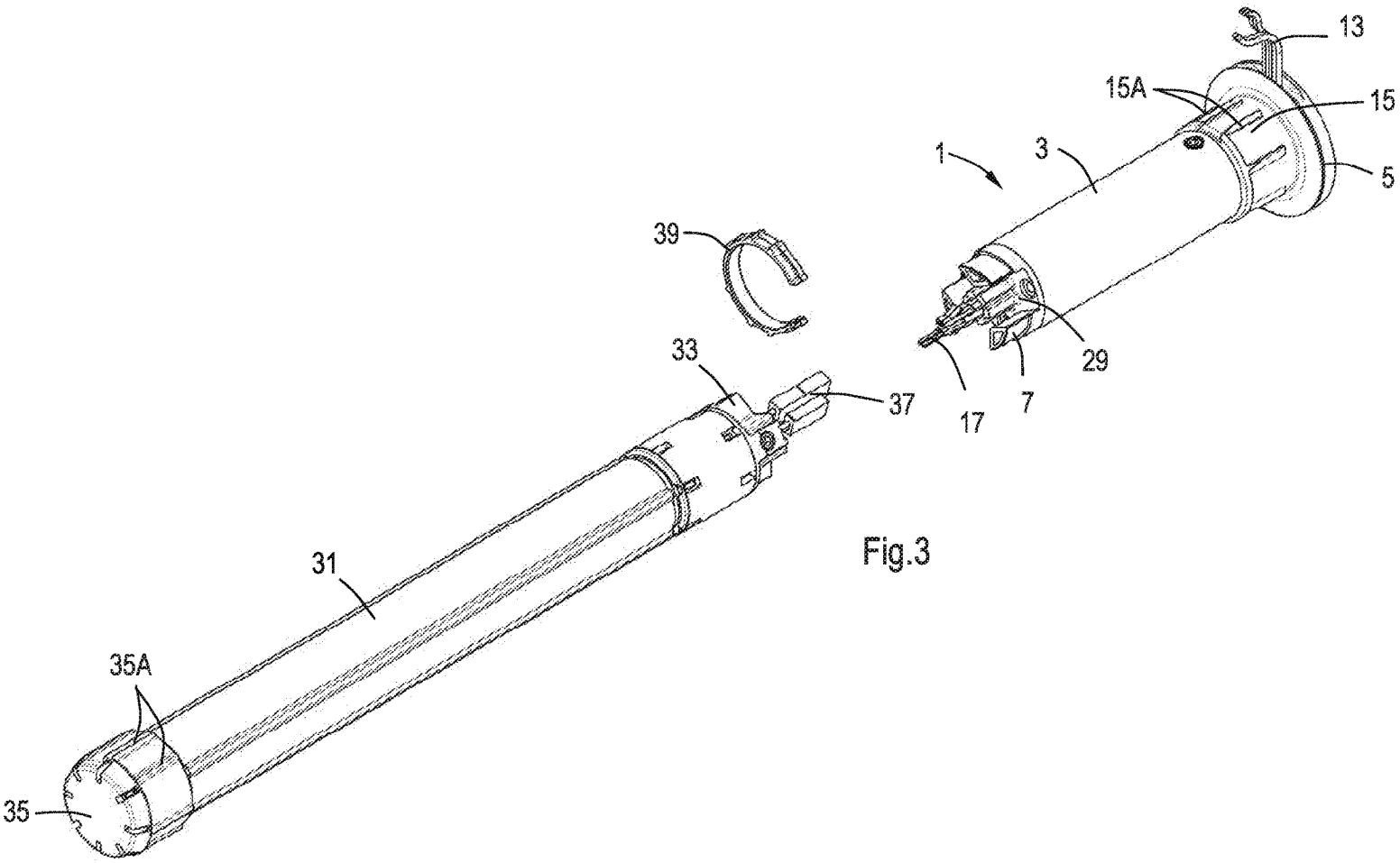
FIG. 3 shows s motor unit and the motor head in an exploded arrangement.

Motor head 1 is shown in FIG. 3 in an exploded arrangement with an electric motor unit 31. The electric motor unit 31 has a stationary end 33 and a rotatable driving end 35. Protruding from the stationary end 33 is an electrical connector socket 37 that is connectable directly, or indirectly, to the connector plug 17. The driving end 35 is provided with external ribs 35A to engage mating formations of an inner wall of a winding core, such as blind roller 106 shown in FIG. 11. For clarity no winding core or blind roller is shown in FIG. 3, but such elements are conventional and well known to the skilled person. Similarly the rotatable collar 15 is also provided with ribs 15A for engaging mating formations on a surrounding winding core. To prevent the stationary end 33 of the motor unit 31 from sagging against the interior of a rotating winding core, an optional bearing collar clip 39 may be mounted in the vicinity of the stationary end 33 of the motor unit 31. The outer circumference of the bearing collar clip 39 may be provided with protrusions 39A for engaging the interior wall of a winding core similar to the ribs 15A and the ribs 35A.

Figure 4:
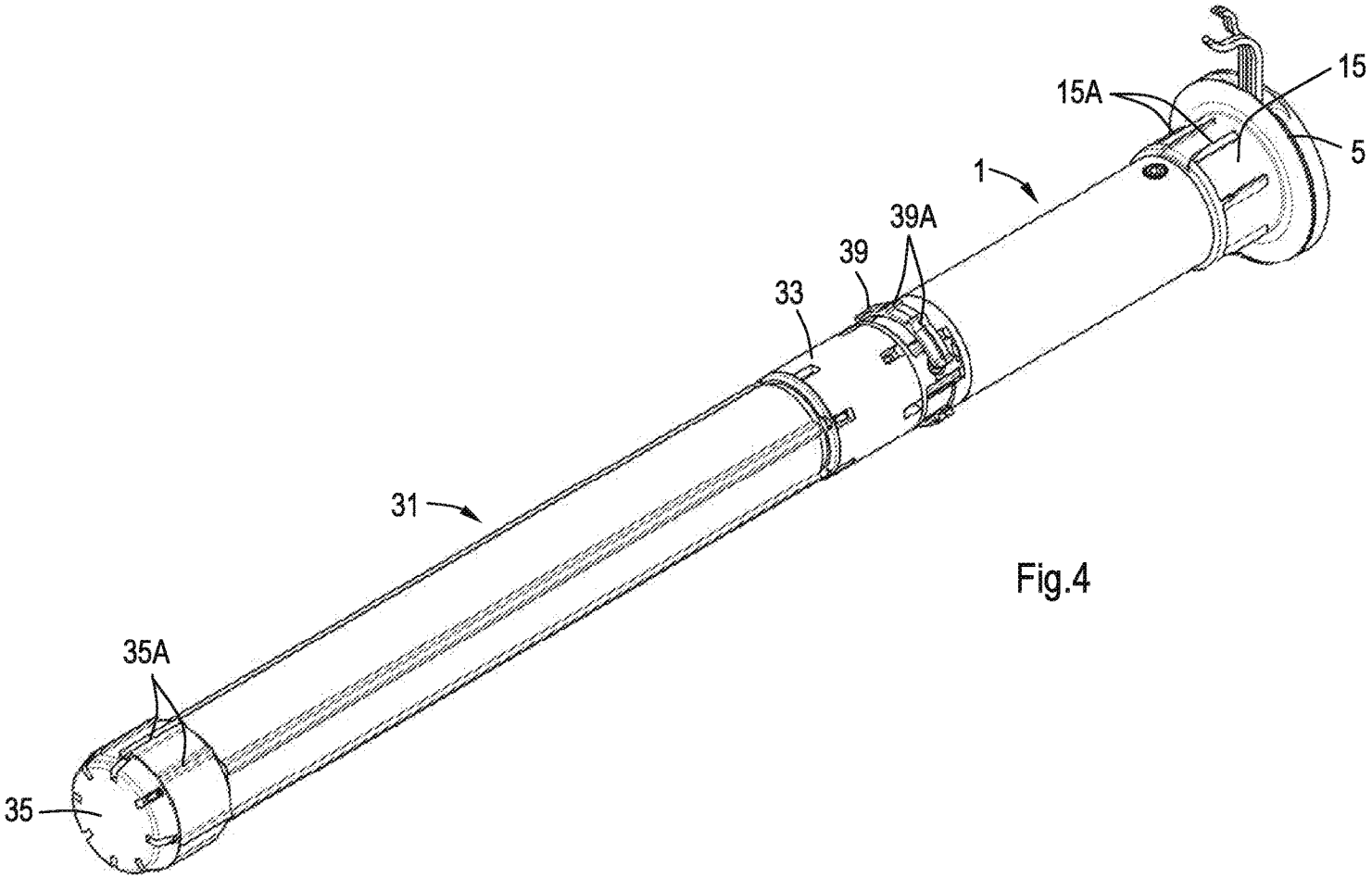
FIG. 4 shows the individual elements of FIG. 3 in an assembled condition.

In one arrangement optionally to the invention as shown in FIG. 4 the motor head 1 may be directly coupled to the electric motor unit 31. The bearing collar clip 39 may then be clipped around the connection between the motor unit 31 and the motor head 1.

Figure 5:
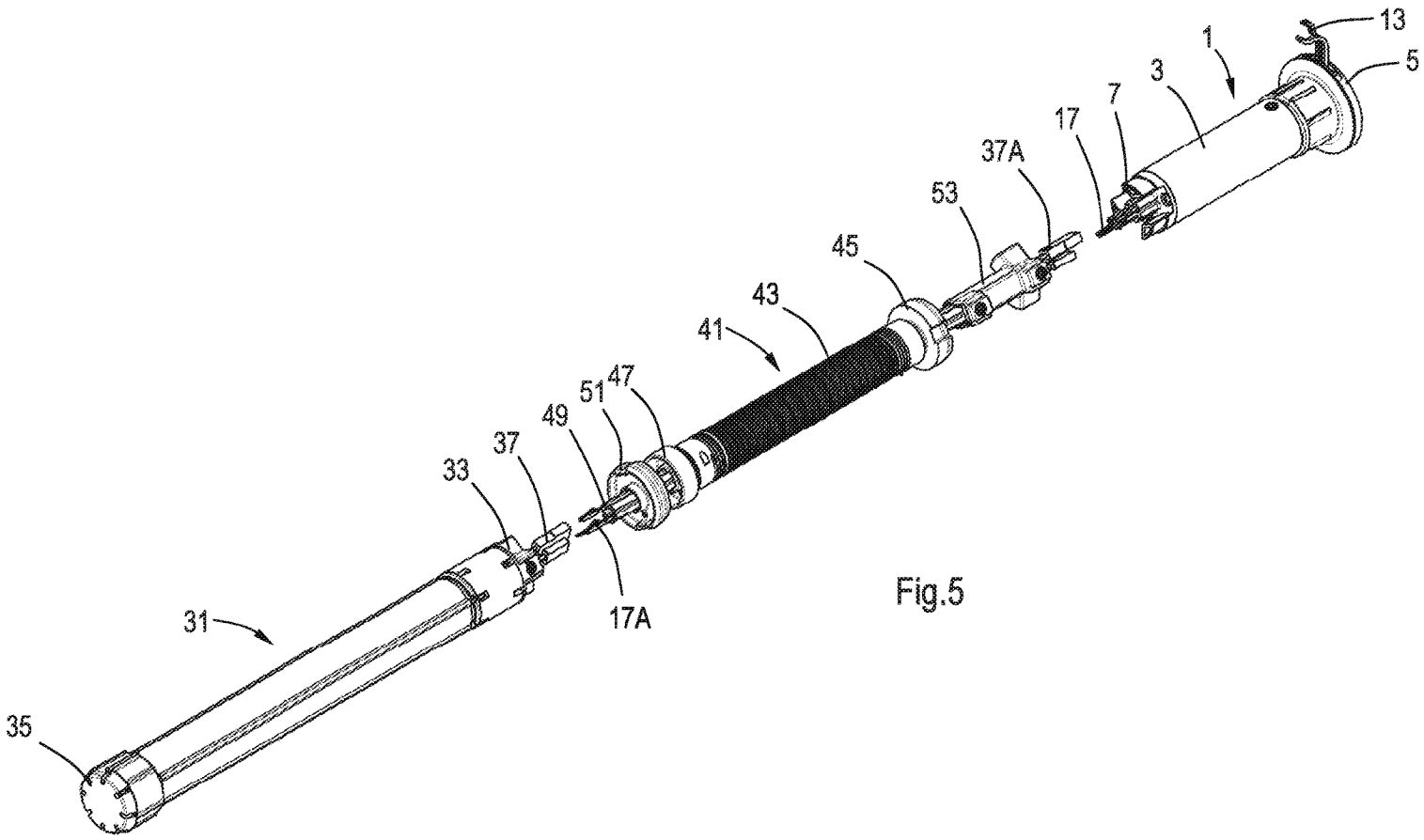
FIG. 5 shows the motor unit and motor head with a spring assist module interposed there between in an exploded arrangement.

In FIG. 5 another optional arrangement of the motor head 1 and motor unit 31 is shown. In the arrangement of FIG. 5 a spring assist module 41 is interposed between the motor head 1 and the motor unit 31. This spring assist unit is generally similar to the units described in applicant's published international patent application WO 2010/089118. For the present description it will therefore be sufficient to briefly describe the components that form the spring assist unit 41. A helically wound torsion spring 43 at one end engages a first plug member 45 that in turn can drivingly engage a winding core (such as blind roller 106 in FIG. 11). The first plug member 45 is rotatably journalled about a stationary central shaft 49. Another end of the helically wound torsion spring 43 engages a second plug member 47, which is designed to allow free rotation with respect thereto of a surrounding winding core. However that second plug member 47 non-rotatably engages splines on the stationary central shaft 49. The stationary central shaft 49 is hollow, so that electrical conduits may extend through its center. Rotatably surrounding the stationary shaft 49 adjacent to the second plug member 47, is a bearing web 51 that is designed to engage an inside of a surrounding winding core, when present. At the opposite end of the spring assist module 41 and beyond the first plug member 45, a shaft coupling 53 is non-rotatably fitted to the stationary shaft 49. At the same end it is seen that electrical connector sockets 37A extend from the shaft coupling 53 to connect to the connector plug 17 of the motor head 1. A connector plug 17A extends from the stationary shaft 49 at an opposite end of the spring assist module 41 for coupling to the connector sockets 37 of the motor unit 31.

Figures 6, 7:
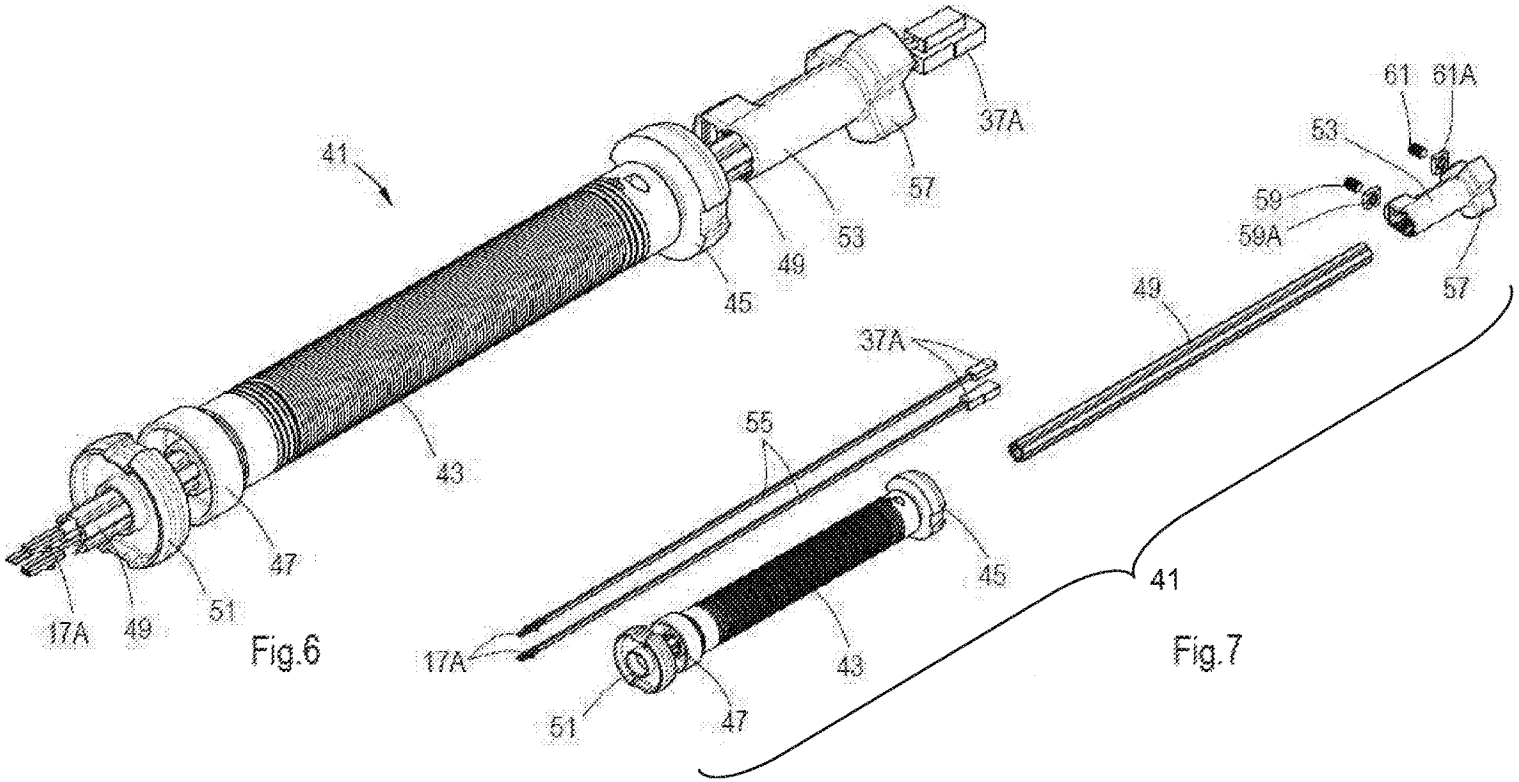
FIG. 6 shows the spring assist module of FIG. 5.
FIG. 7 shows the spring assist module of FIG. 5 in an exploded arrangement.
Figure 8:
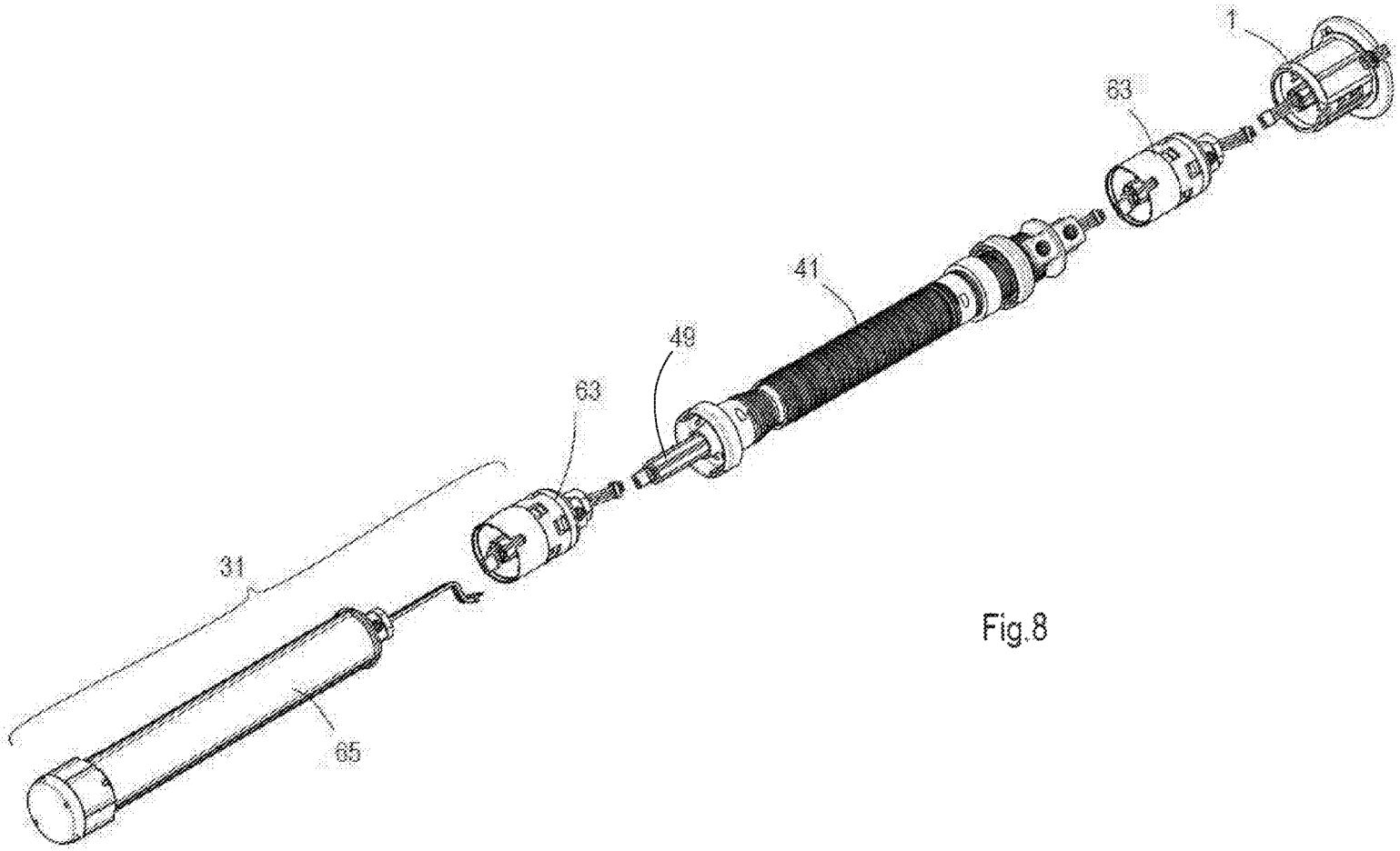
FIG. 8 is an exploded arrangement similar to FIG. 5 but now with additional buffer couplings interposed at opposite ends of the spring assist module.
Figure 10:
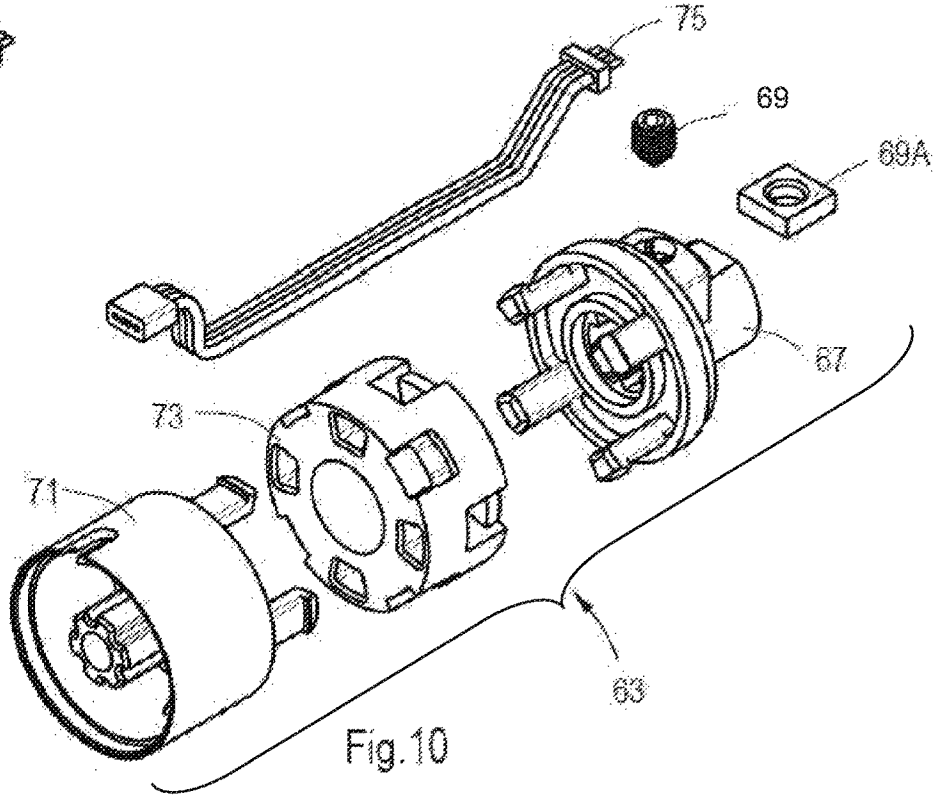
FIG. 10 is an exploded view of the buffer coupling of FIG. 9.
Figure 9:
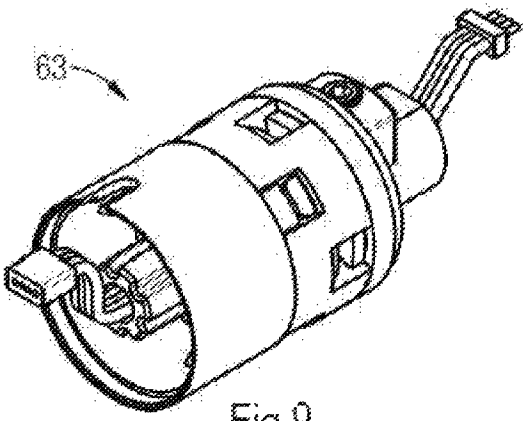
FIG. 9 is an isometric view of the buffer coupling of FIG. 8.

As shown in more detail in FIGS. 6 and 7 the spring assist module 41 has an electric cable 55 extending through the hollow interior of the splined stationary shaft 49. One end of the cable 55 is provided with the connector sockets 37A, while the other end of cable 55 is provided with the connector plug 17A. It will be clear to the skilled person that it would also be possible to form the electrical conduit integrally within the hollow interior of the stationary shaft 49. Similarly the electrical connector plugs and sockets may also be integrated with the ends of the stationary shaft 49. The shaft coupling 53 may be fixedly clamped to the stationary shaft 49 by a first set screw 59 engaging a nut 59A in the shaft coupling 53. The shaft coupling 53 may also be clamped to the coupling protrusion 29 of the inner end member 7 of the motor head 1 by a second set screw 61, engaging a corresponding nut 61A in the shaft coupling 53. In a still further elaborated optional arrangement, illustrated in FIG. 8, additional buffer coupling 63 are interposed at each opposite end of the spring assist module 41. One of the buffer couplings 63 may be an integral part of the electric motor unit 31 and thus may form the stationary end (such as 33 in FIGS. 3, 4 and 5) attached to an electric motor 65. The motor head 1 is merely schematically represented in FIG. 8, but may be similar in shape to the motor head shown in the other Figures. The buffer coupling 63 is shown in more detail in FIGS. 9 and 10. The buffer coupling 63 includes a first connector 67 that can non-rotatably engage the splined stationary central shaft 49 and be clamped thereto by a set screw 69 that engages a nut 69A positioned in a cavity of the first connector 67. A second connector 71 is adapted to non-rotatably engage either one of the electric motor 65, or the exposed end 57 of the shaft coupling 53. Suitable formations on confronting faces of the first and second connectors 67, 71 engage complementary formation of a resilient block member 73, interposed between these confronting faces. The resilient block member 73 can conveniently be a rubber part or some other resilient configuration. Again all of the first connector 67, the resilient block member 73, and the second connector 71 have a central through bore to allow an electrical connecting cable 75 to extend there through. The addition of buffer couplings 63 assists in absorbing torque changes and start and stop impacts of the motor unit 31 and spring assist module 41 that would otherwise be transmitted to the motor head 1.

FIG. 11 shows one type of architectural covering in which the extending and retraction mechanism of the present invention may be employed. This architectural covering is in the form of a roller blind 100 that has a blind roller 106 that is mounted for rotation between opposite first and second mounting brackets 102, 104. A flexible screening material such as a shade cloth 108 is windable to and from the blind roller 106 to be extended within or be retracted from an architectural opening (not shown in FIG. 11, but conventional). To assist in unwinding the shade cloth 108 from the roller 106 a weight bar 110 is attached to the bottom of the shade cloth 108. The extension and retraction mechanism according to the various embodiments described herein above may be entirely accommodated with the hollow interior of the blind roller 106, which acts as a winding core for a flexible element in the form of shade cloth 108. The motor head 1 of the various embodiments will have its outer end member 5 non-rotatably engaged by one of the mounting brackets 102 or 104. The electrical wires 13 extending from the outer end member 5 can thereby easily connect to a power source or electrical switchgear. Alternatively or additionally mechanical switches or optical eyes provided in the motor head can be positioned within reach of an external tool or operation device.

Accordingly a mechanism is disclosed for extending and retracting an architectural covering member 108 between opposite first and second end positions. The mechanism includes an electric motor unit 31 having a stationary end 33 and a rotating end 35 for rotating a winding core, such as a roller blind shaft 106, for receiving wound layers of a flexible element, such as a sheet of flexible material 108 thereon, and a spring assist module 41. The mechanism further includes a motor head 1, separate from the electric motor unit 31, providing external electrical control for the motor unit 31 and an electrical interface between the motor head 1 and the motor unit 31. A printed circuit board 19 accommodated in the motor head 1 may include at least one of end position limit switches, a switch for setting the first and second end positions, electronic communication means, or a remote control receiver. The electrical interface may include an electrical connector plug 17; 17A, an electrical socket 37; 37A, and/or an electrical cable 55; 75.

The spring assist module 41 may include a helically wound torsion spring 43 that is selected from a predefined range of incremental lengths to best ensure a constant operating force. This can be achieved by taking into account the relevant physical parameters of the architectural covering and the mechanism for extending and retracting, as described in applicant's published international patent application WO 2010/089118.

It is also clear from the foregoing description that the spring assist module 41 and buffer coupling 63 may constitute a modular kit of self-contained parts that each may selectively be combined individually with the motor unit 31 and motor head 1 in any number between zero and two.

It is thus believed that the operation and construction of the present invention will be apparent from the foregoing description. To the skilled person in this field of the art it will be clear that the invention is not limited to the embodiments represented and described here, but that within the framework of the appended claims a large number of variants are possible. Also kinematic inversions are considered inherently disclosed and to be within the scope of the present invention. The terms comprising and including when used in this description or the appended claims should not be construed in an exclusive or exhaustive sense but rather in an inclusive sense. Expressions such as: "means for . . . " should be read as: "component configured for . . . " or "member constructed to . . . " and should be construed to include equivalents for the structures disclosed. The use of expressions like: "critical", "preferred", "especially preferred" etc. is not intended to limit the invention. In this regard, the terms in the foregoing description and the appended claims, such as "upper", "lower", "right", and "left", have been used only as relative terms to describe the relationships of the various elements. Features which are not specifically or explicitly described or claimed may be additionally included in the structure according to the present invention without deviating from its scope.

The invention claimed is:

1. Architectural covering comprising:

a drive mechanism for extending and retracting a covering member between opposite first and second end positions, and a winding core for receiving wound layers of a flexible element during retraction of the covering member, wherein the drive mechanism includes:

an electric motor unit having a stationary end and a rotating end for rotating the winding core;

a motor head coupled to the electric motor unit via an electrical interface for providing electrical control to the motor unit, the motor head including:

a housing spaced axially apart from the electric motor unit;

at least one of communication electronics;

a printed circuit board with end position limit switches, a switch for setting the first and second end positions, or a remote control receiver accommodated in the housing; and an outer end member coupled to the housing and configured to engage a mounting bracket; and a coupling to physically couple the motor head housing to the electric motor unit, the coupling preventing relative rotation between the motor head and the stationary end of the electric motor unit and between the stationary end of the electric motor unit and the outer end member, the coupling extending from an inner end of the motor head opposite the outer end member.

2. Architectural covering according to claim 1, wherein the drive mechanism is accommodated in the winding core.

3. Architectural covering according to claim 1, wherein the drive mechanism is accommodated in a rail or cassette of the architectural covering.

4. Architectural covering according to claim 2, wherein the motor head is positioned immediately adjacent one end of the winding core.

5. Architectural covering according to claim 1, wherein the electrical interface includes an electrical connector plug and an electrical socket.

6. Architectural covering according to claim 1, wherein the electrical interface includes a cable.

7. Architectural covering according to claim 1, wherein the drive mechanism comprises at least one spring assist module.

8. Architectural covering according to claim 1, wherein the drive mechanism includes a bearing collar that can be clipped onto the motor unit for additional support of the stationary end thereof.

9. Architectural covering according to claim 1, wherein the drive mechanism includes a stationary central shaft.

10. Architectural covering according to claim 1, wherein the flexible element is a sheet of flexible material.

11. Architectural covering according to claim 1, wherein the winding core is a roller blind shaft.

12. The architectural covering of claim 1, wherein the motor head includes:

a stationary stub axle coupling the outer end member to the housing and extending at least partially inside the housing.

13. Architectural covering according to claim 1, wherein the coupling is at least one of a protrusion, a rib, or a serration.

14. Architectural covering comprising:

a winding core for receiving wound layers of a flexible element during retraction of the covering member; and a drive mechanism for extending and retracting a covering member between opposite first and second end positions, the drive mechanism including:

an electric motor unit having a stationary end and a rotating end for rotating the winding core; and a motor head coupled to the electric motor unit via an electrical interface for providing electrical control to the motor unit, the motor head including:

a housing spaced axially apart from the electric motor unit;

at least one of communication electronics, a printed circuit board with end position limit switches, a switch for setting the first and second end positions, or a remote control receiver accommodated in the housing; and an outer end member coupled to the housing and configured to engage a mounting bracket; and at least one spring assist module is interposed between the motor unit and the motor head.

15. Architectural covering according to claim 14, wherein the at least one spring assist module includes a helically wound torsion spring that is selected from a predefined range of incremental lengths.

16. Architectural covering according to claim 14, wherein the at least one spring assist module includes a helically wound torsion spring that is selected according to a protocol that takes into account the relevant physical parameters of the architectural covering and the drive mechanism to provide a constant operating force.

17. Architectural covering according to claim 14, wherein the electrical interface includes a cable, and wherein the cable extends through the at least one spring assist module.

18. Architectural covering according to claim 14, wherein the drive mechanism comprises at least one buffer coupling.

19. Architectural covering according to claim 18, wherein the at least one buffer coupling is interposed between the motor unit and the motor head, and/or between the motor unit and a spring assist module, and/or between a spring assist module and the motor head, and/or between two spring assist modules.

20. An architectural covering comprising:

a covering member movable between opposing first and second end positions;

a winding core for receiving wound layers of a flexible shade element during movement of the covering member between the opposing first and second end positions; and a drive mechanism for moving the covering member between the opposing first and second end positions, the drive mechanism comprising:

an electric motor unit including a stationary end and a rotating end for rotating the winding core; and a motor head positioned adjacent an end of the winding core, the motor head being physically separate and spaced apart from the electric motor unit and coupled thereto via an electrical interface to provide external electrical control to the electric motor unit, the motor head comprising;

a housing spaced axially apart from the electric motor unit;

at least one of communication electronics, a printed circuit board with end position limit switches, a switch for setting the first and second end positions, or a remote control receiver accommodated in the housing; and an outer end member coupled to the housing and engageable to a mounting bracket operable to mount the architectural covering and a coupling to physically couple the motor head housing to the electric motor unit, the coupling preventing relative rotation between the motor head and the stationary end of the electric motor unit and between the stationary end of the electric motor unit and the outer end member, the coupling extending from an inner end of the motor head opposite the outer end member.

21. The architectural covering of claim 20, wherein the motor head is positioned nearer the end of the winding core than the electric motor unit.

22. The architectural covering of claim 20, wherein the rotating end of the electric motor unit engages an inner wall of the winding core.

23. The architectural covering of claim 20, wherein the rotating end of the electric motor unit and a portion of the motor head rotatably support the winding core.

24. The architectural covering of claim 20, wherein the outer end member is stationary.

25. An architectural covering comprising:

a winding core; and a drive mechanism for rotating the winding core, the drive mechanism comprising:

an electric motor unit including a stationary end and a rotating end for rotating the winding core; and a motor head received at least partially within an end of the winding core and coupled to the electric motor unit via an electrical interface to provide electrical control for the electric motor unit, the motor head including:

a housing spaced axially apart from the electric motor unit and including a first end and a second end, the first end positioned closer to the electric motor unit than the second end;

a printed circuit board received within the housing;

an inner end member distinct from and engaged with the first end of the housing; and a coupling to physically couple the motor head housing to the electric motor unit, the coupling preventing relative rotation between the motor head and the stationary end of the electric motor unit and between the stationary end of the electric motor unit and the first end member, the coupling extending from an inner end of the motor head opposite the first end member.

26. The architectural covering of claim 25, wherein the electrical interface protrudes from the inner end member.

27. The architectural covering of claim 25, wherein the motor head includes an outer end member and a rotatable collar positioned between the second end of the housing and the outer end member.

* * * * *